US005695299A

United States Patent [19]

Thomas et al.

[11] Patent Number: 5,695,299

[45] Date of Patent: Dec. 9, 1997

[54] MULTI-TOOLED DEPRESSION MILLING MACHINE

[76] Inventors: Glen Edward Thomas; Amona Dianne Thomas, both of P.O. Box 1083, Moore Haven, Fla. 33471

[21] Appl. No.: 625,206

[22] Filed: Apr. 1, 1996

Related U.S. Application Data

[63] Continuation-in-part of Ser. No. 471,858, Jun. 6, 1995, Pat. No. 5,503,499, and Ser. No. 513,355, Aug. 10, 1995, Pat. No. 5,604,255, which is a continuation-in-part of Ser. No. 391,708, Feb. 21, 1995, Pat. No. 5,484,228, which is a continuation-in-part of Ser. No. 118,961, Sep. 10, 1993, Pat. No. 5,391,017.

[51] Int. Cl.[6] ..... E01C 23/09

[52] U.S. Cl. ..... 404/94; 404/15

[58] Field of Search ..... 404/84.05, 90, 404/93, 94, 72, 75; 299/39.4, 39.6

[56] References Cited

U.S. PATENT DOCUMENTS

| | | | |
|---|---|---|---|
| 5,094,565 | 3/1992 | Johnson | 404/90 X |
| 5,391,017 | 2/1995 | Thomas et al. | 404/90 |
| 5,415,495 | 5/1995 | Johnson | 404/84.05 |
| 5,456,547 | 10/1995 | Thomas et al. | 404/72 |
| 5,484,228 | 1/1996 | Thomas et al. | 404/90 |
| 5,503,499 | 4/1996 | Thomas et al. | 404/72 |
| 5,540,516 | 7/1996 | Nicodemo et al. | 404/93 X |
| 5,607,255 | 3/1997 | Thomas et al. | 404/90 |

*Primary Examiner*—James Lisehora

[57] ABSTRACT

The disclosure explains machines to provide for forming depression using multiple cutting tools. The cutting tools may operate in a simultaneous cycling mode, where the cutting tools form depressions at the same time, or in an alternating cycling mode where the cutting tools form depressions at unique periods during operation. The individual cutting tools may make plunge cuts, near plunge cuts, or mill through cuts. Regulation of the cutting cycles of each cutting tool may be controlled using a direct transfer, as exampled by cam wheels, or using an indirect transfer, as exampled by electronic measurement of travel of the milling machine. A determination of the proper spacing between adjacent cutting tools is dependant upon the type of cycling mode, the total cutting tool count and a measurement of the separation spacing between adjacent depressions. Blocking selectively prevents implementation of select cutting cycles to allow installation of series either having true continuous installation or having skip patterns incorporated therein.

14 Claims, 13 Drawing Sheets

30
34
40
46
36
38
70
58
52
32
54
42
56
48
50
44

30
34
40
60
36
62
38
70
58
52
32
54
42
56
48
50
44

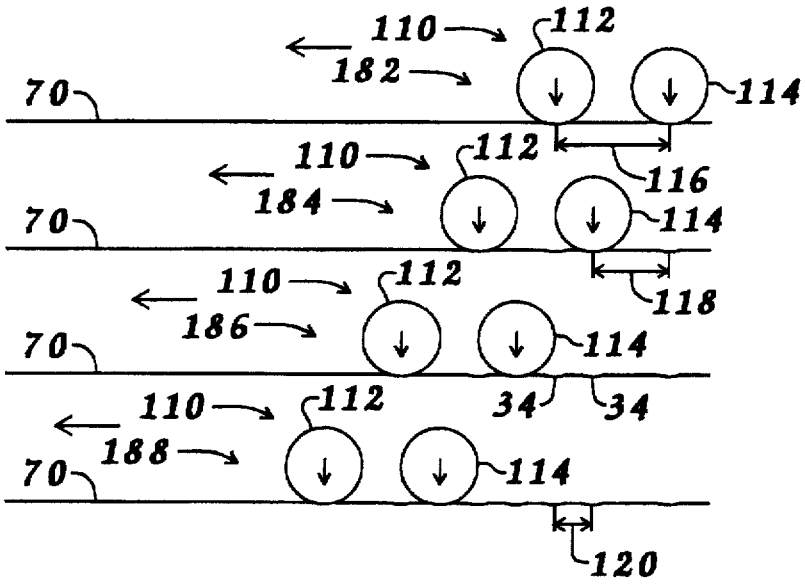
FIG. 8a
FIG. 8b
FIG. 8c
FIG. 8d
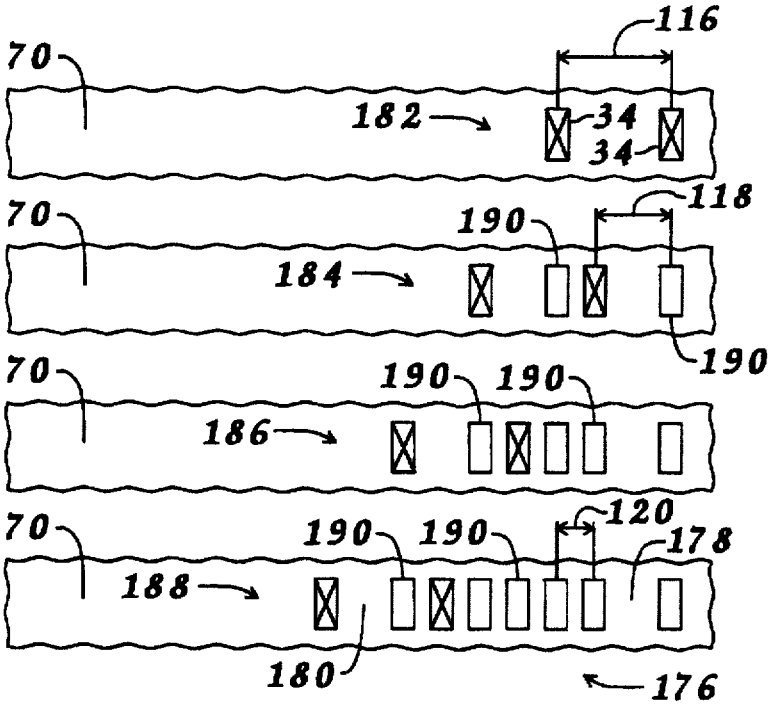
FIG. 9a
FIG. 9b
FIG. 9c
FIG. 9d

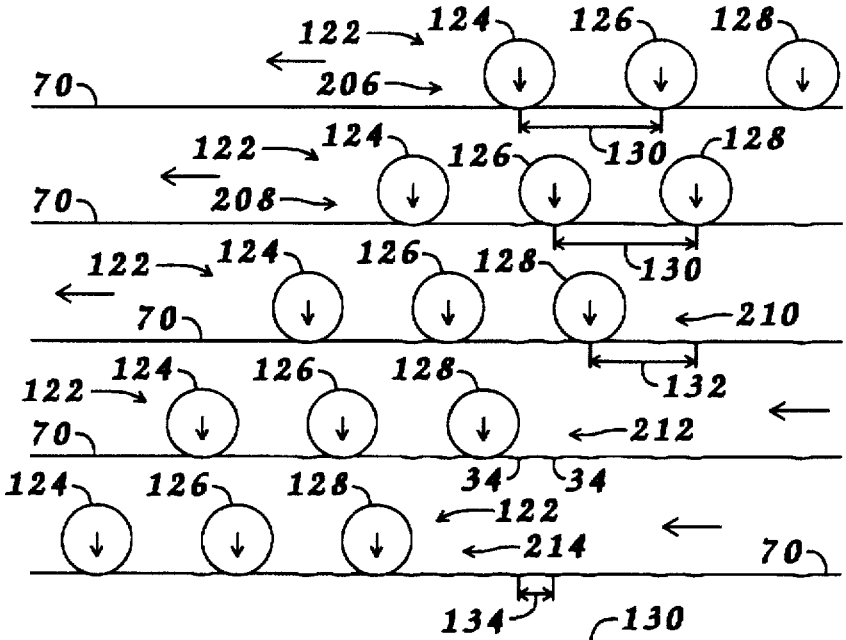
FIG. 10a
FIG. 10b
FIG. 10c
FIG. 10d
FIG. 10e
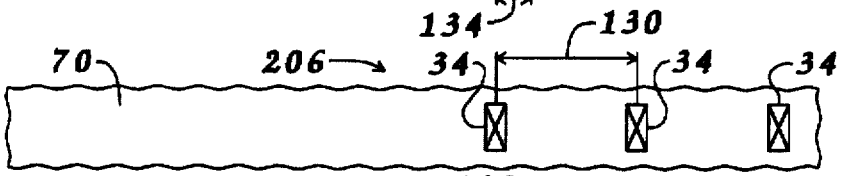
FIG. 11a
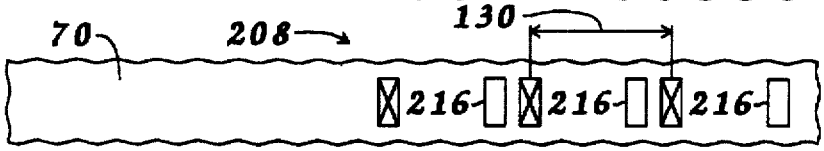
FIG. 11b
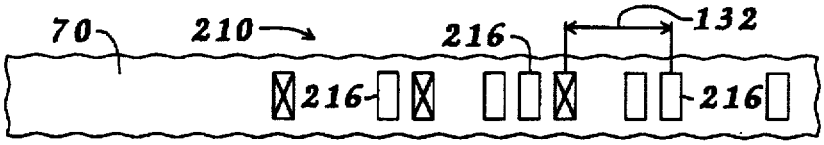
FIG. 11c
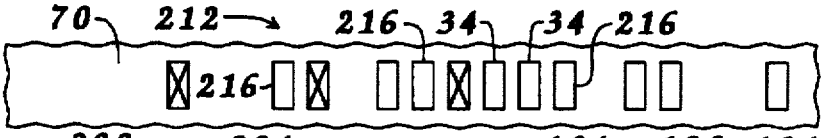
FIG. 11d
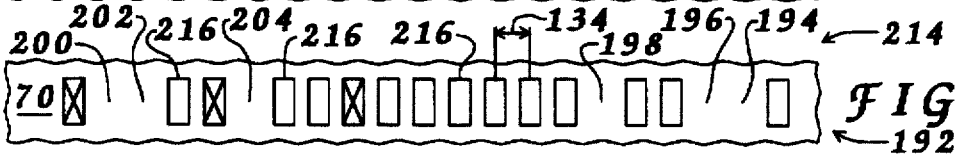
FIG. 11e

MULTI-TOOLED DEPRESSION MILLING MACHINE

CROSS-REFERENCES

This application is a continuation-in-part application of U.S. Pat. No. 5,604,255, Ser. No. 08/513,355, filed Aug. 10, 1995, entitled "Method of Milling Through to Form Highway Depressions" which is a continuation-in-part application of U.S. Pat. No. 5,484,228, Ser. No. 08/391,708, filed Feb. 21, 1995, entitled "Continuous Moving Highway Depression Cutting"; which is a continuation-in-part application of U.S. Pat. No. 5,391,017, Ser. No. 08/118,961, filed Sep. 10, 1993, entitled "Continuous Moving Depression Cutting Tool for Highway Use". This application is a continuation-in-part application of U.S. Pat. No. 5,503,499 Ser. No. 08/471,858, filed Jun. 6, 1995, entitled "Impact Formed Depressions and Installation Machine". This application is related to U.S. Pat. No. 5,456,547, Ser. No. 08/179,672 filed Jan. 11, 1994, entitled "Cutting of Repetitive Depressions in Roadway Surface". All of these applications are incorporated herein by this reference.

BACKGROUND

1. Field of the Invention

Generally, the invention relates to milling the surface of a road to form a series of depressions. More specifically, the invention relates to the use of multiple cutting tools to form these depressions.

2. Description of the Prior Art

Sonic noise alert pattern, (SNAP), or rubble strips, are a series of shallow depressions formed in the surface of roads. The pattern has the purpose of providing vibration and noise when the tires of a vehicle traverse them longitudinally. Road departments use these depressions as a safety device. Adjacent the edge of a highway or along the center line which divides the opposing directional traffic flows are common locations of placement. They act to alert a driver that his or her vehicle has extended beyond the normal driving surface. Beyond this normal driving surface many dangerous conditions exist for a vehicle traveling near the posted speed limit. These dangers include, amongst others, dirt or gravel shoulders, guardrail barriers, signs, mailboxes, intersecting roadways or driveways and stationary vehicles. Limited access highways and rural roads are likely locations for SNAP depressions to be installed due to the fatigue that a driver experiences during extended driving on such roads.

The various specifications for the physical dimensions of the individual depressions and their respective placement can vary from state to state and even within a particular state. A common size and placement, used only for illustration and not limitation, places the individual depressions twelve inches apart from the center of one depression to the center of each adjacent depression. The measurements of the individual depressions being seven inches from back trailing edge to front leading edge with a depth, at the deepest point, of one half inch and a lateral length across of sixteen inches. These specifications result in five inches of uncut surface between each set of adjacent depressions. Therefore, the above specifications would require fifty-two hundred and eighty cuts per mile.

A recent innovation in the specifications for the installation of SNAP type depressions requires a skip pattern to be incorporated within the series. One example of such a series has eight depressions spaced as detailed above followed by an uncut area equal to the normal placement of four depressions. Such installation affords reasonable coverage of a highway while reducing installation expense.

Conventional installation of SNAP type depressions utilize at least one rotary cutting tool with a plunge cut from a stationary position. Advancement of the machine following the stationary plunge cut occurs and the stationary cutting procedure is repeated. Repetition of this action results in installation of depressions along the desired path of the series. Other conventional methods involve using a single milling tool and regulating the elevation thereof during advance of the machine.

Known multi-tooled cutting machines must pause and make plunge cuts simultaneously with all the deployed cutting tools. These machines also rely upon two separate and distinctly measured advances to regulate the placement of depressions within the formed series. These advances are alternated between a short advance and a long advance. The short advance is equal to a measurement of the placement separation spacing of adjacent depressions. The long advance is equal to a measurement of the placement separation multiplied by the number of depressions formed by the two cutting actions, twice the tool count, minus a measurement of the placement separation spacing of adjacent depressions.

Various attempts have been made to provide a machine capable of quickly, accurately, consistently and precisely installing SNAP type depressions. These attempts have been less efficient than desired. As such, it may be appreciated that there continues to be a need for a method of forming SNAP type depressions using a multi-tooled milling machine capable of uniform advance during the milling operation. The present invention substantially fulfills these needs.

SUMMARY

In view of the foregoing disadvantages inherent in the known types of machines to install SNAP depressions, your applicants have devised a method of forming depressions using a multi-tooled machine. The cutting tools may operate in a simultaneous cycling mode, where the cutting tools form depressions at the same time, or in an alternating cycling mode where the cutting tools form depressions at unique periods during operation. The individual cutting tools may make plunge cuts, near plunge cuts, or make mill through cuts. Regulation of the cutting cycles of each cutting tool may be controlled using a direct transfer, as exampled by cam wheels, or using an indirect transfer, as exampled by electronic measurement of the travel of the milling machine. A determination of the proper spacing between adjacent cutting tools is dependant upon the type of cycling mode, the total cutting tool count and a measurement of the separation spacing between adjacent depressions.

Our invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for multiple cutting tools to cooperate to form a series of depressions.

Other object include;

a) to provide for uniform travel along the surface by each cutting tool between cutting cycles.

b) to provide for control means to regulate cycles of lowerings and raisings.

c) to provide for an increase in the duration of time between cutting tooth replacement to permit prolonged operation of the machine during installation.

d) to provide for simultaneous cycling of the cutting tools.

e) to provide for alternating cycling of the cutting tools.

f) to provide for proper spacing of the cutting tools for simultaneous cycling.

g) to provide for proper spacing of the cutting tools for alternating cycling.

h) to provide for blocking means to eliminate selective cyclings of select cutting tools.

i) to provide for milling of a continuous series of depressions.

j) to provide for milling of a series of depressions having a skip pattern incorporated therein.

k) to provide for continuous advance of the machine during formation of the series.

l) to provide for pausing the machine during formation of a group of depressions within the series.

m) to provide for a uniform advance between pauses during installation of depressions within the series.

n) to provide for formation of depressions wherein each cutting tool is fully lowered into contact with the road and raised out of contact with the road with little forward motion of the cutting tool while in contact with the road to make a plunge cut.

o) to provide for formation of depressions wherein each cutting tool is fully lowered into contact with the road and raised out of contact with the road with significant forward motion of the cutting tool while in contact with the road to make a mill through cut.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 8*a* through FIG. 8*d* are side plan views depicting a cutting action of two cutting tools operating in a synchronized cycling mode.

FIG. 9*a* through FIG. 9*d* are overhead plan views of a cutting pattern formed by the cutting actions shown in FIG. 8*a* through FIG. 8*d*.

FIG. 10*a* through FIG. 10*e* are side plan views depicting a cutting action of three cutting tools operating in a synchronized cycling mode.

FIG. 11*a* through FIG. 11*e* are overhead plan views of a cutting pattern formed by the cutting actions shown in FIG. 10*a* through FIG. 10*e*.

DESCRIPTION

Figure 1:
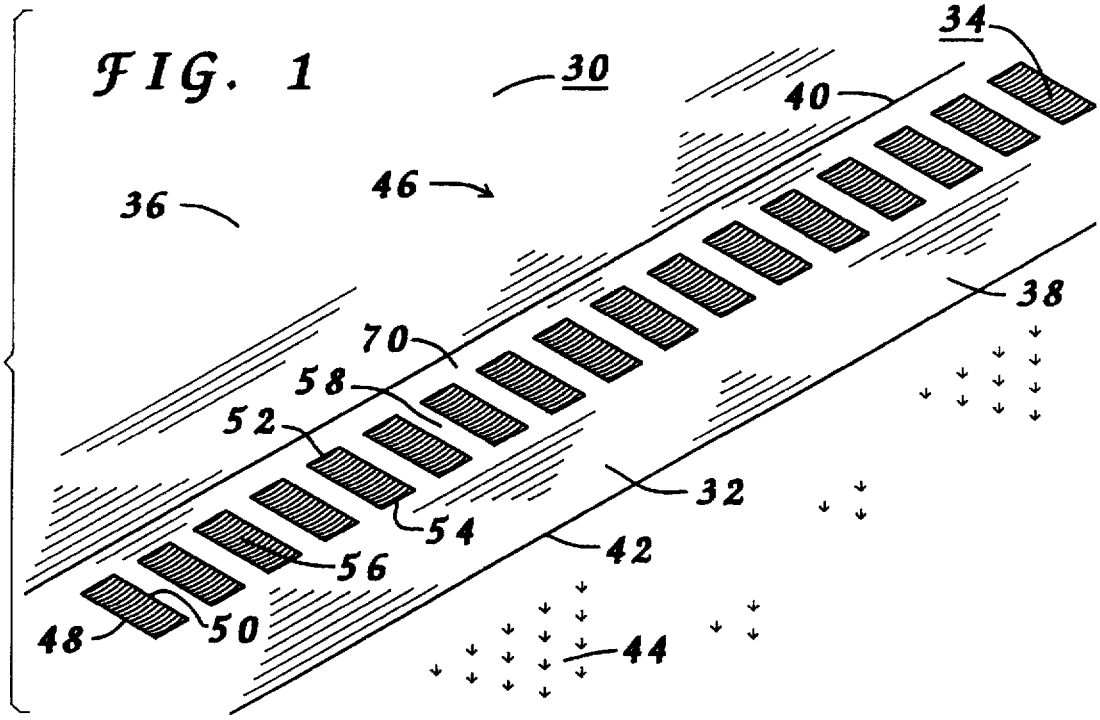
FIG. 1 is a perspective view of a series of depressions.

Referring now to the drawings where like reference numerals refer to like parts throughout the various views.

Installation Locations

Several locations are applicable for the installation of SNAP type depressions, as mentioned above. Attention is now directed toward installations along a roadway in the edging separating a driving lane from the earthen ground shoulder. This area is hereafter referred to as an extended edge. Asphalt, concrete or any other suitable material may form the extended edge. Bridges, intersecting roads and, occasionally, driveways intersecting the road may interrupt each section of the highway. At these locations it may not be feasible or desirable to install SNAP type depressions. Therefore, each section of highway is dividable into segments of installation which each receive an installation of SNAP type depressions.

There are two types of installations of SNAP type depressions. The first type is a continuous series while the second type is a series having a skip pattern incorporated therein. A continuous series is a series having depressions installed with an even spacing between adjacent depressions uninterrupted along each segment of installation. A skip pattern series is a series having depressions placed in definable groups with a predetermined spacing of untreated roadway separating adjacent groups within each segment of installation.

Figure 2:
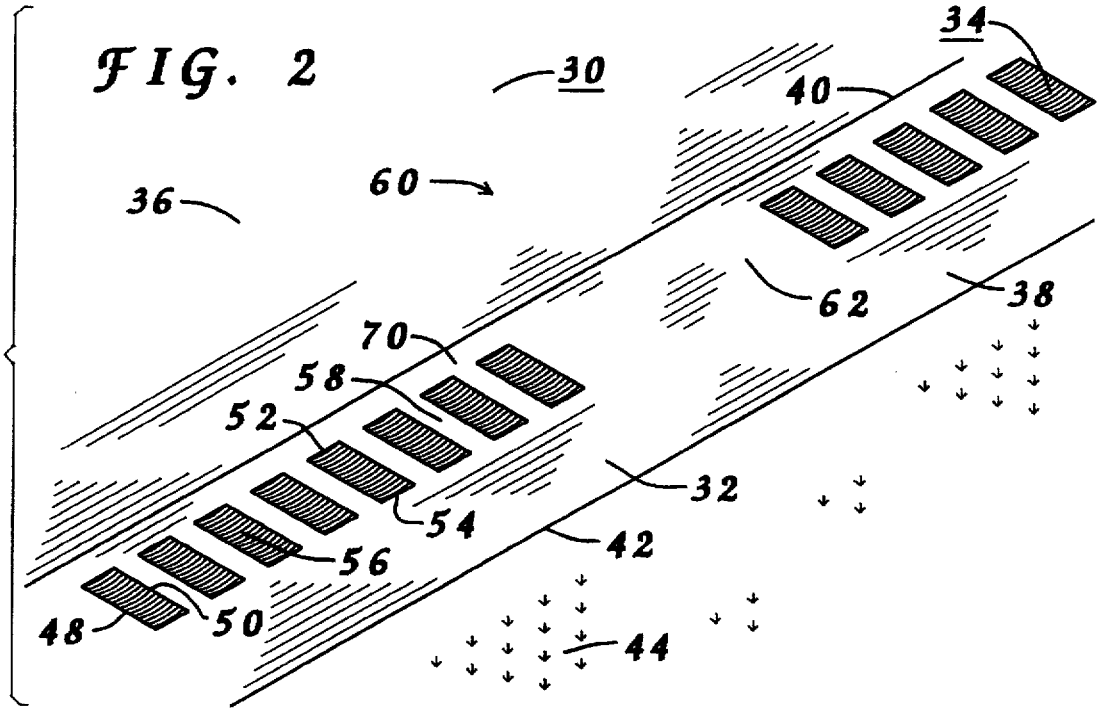
FIG. 2 is a perspective view of a series of depressions having a skip pattern incorporated therein.
Figure 3A:
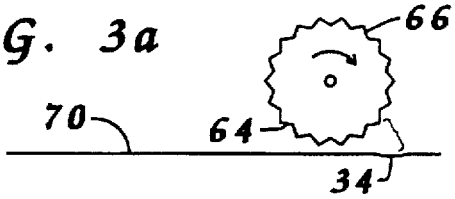
FIG. 3*a* through FIG. 3*g* are side plan views depicting a plunge cutting operation performed from a stationary position.
Figure 4A:
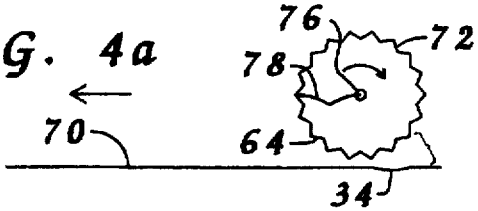
FIG. 4*a* through FIG. 4*g* are side plan views depicting a plunge cutting operation performed during forward advance.
Figure 3B:
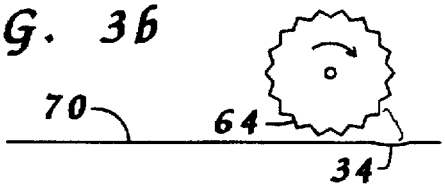
Figure 4B:
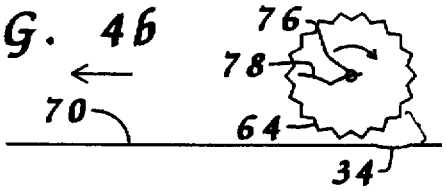
Figure 3C:
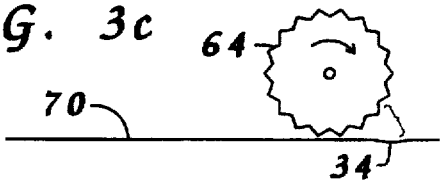
Figure 4C:
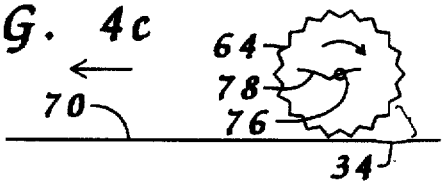
Figure 3D:
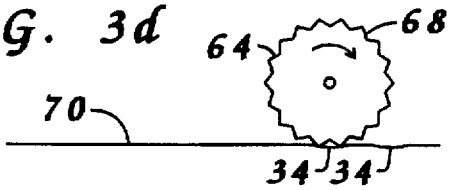
Figure 4D:
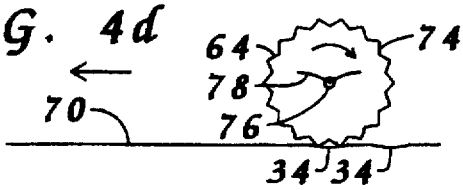
Figure 3E:
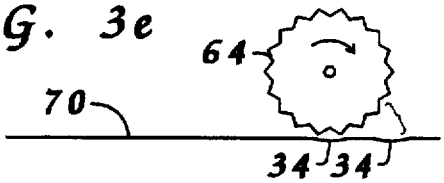
Figure 4E:
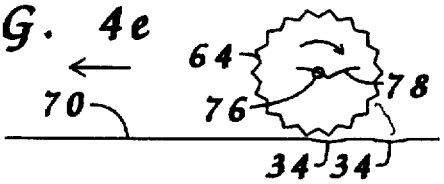
Figure 3F:
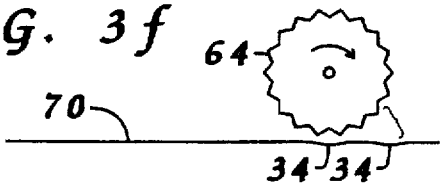
Figure 4F:
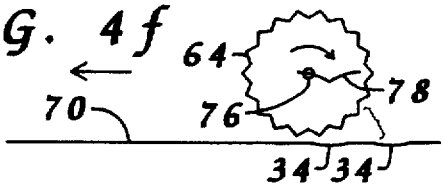
Figure 3G:
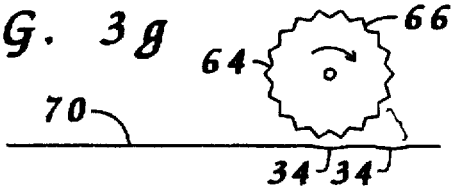
Figure 4G:
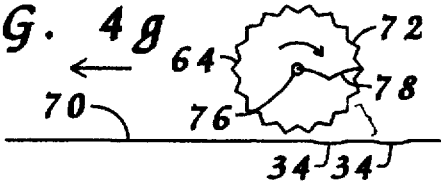
Figure 5A:
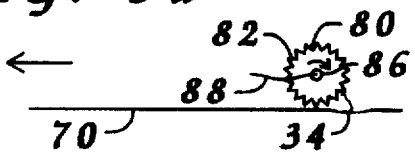
FIG. 5*a* through FIG. 5*g* are side plan views depicting a mill through cutting operation.
Figure 5B:
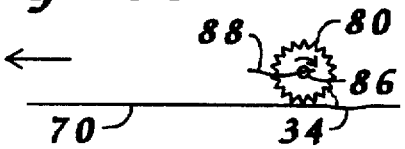
Figure 5C:
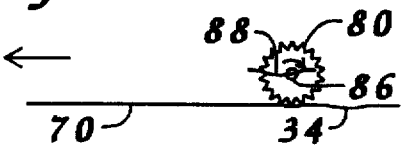
Figure 5D:
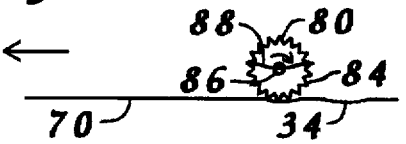
Figure 5E:
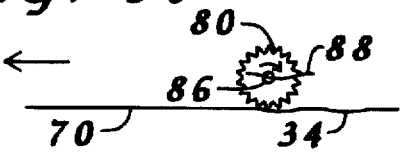
Figure 5F:
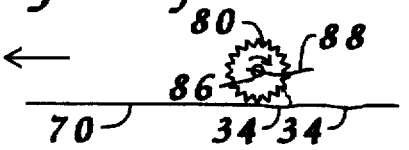
Figure 5G:
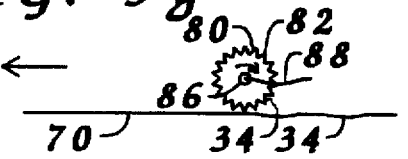

FIG. 1 and FIG. 2 depict installations of two series of depressions 34 into a surface 70. FIG. 1 depicts an installation of a continuous series 46 along a roadway 30, formed of a material 32, and separated into two distinct areas by a side marking line 40. These two areas are a driving surface 36 and an extended edge 38. Roadway 30 is separated from a shoulder 44 by an edge of pavement 42. Extended edge 38 has installed in surface 70 a series of seventeen, (17), depressions 34 in FIG. 1 while FIG. 2 has installed in surface 70 thirteen, (13), depressions 34. Each depression 34 has a first edge 48 and a second edge 50. Edges 48 and 50 are relatively perpendicular to edge of pavement 42 and each is transitional, gradually sloping into depression 34. Each depression 34 further has a first side 52 and a second side 54. Sides 52 and 54 are relatively parallel to edge of pavement 42. Each depression 34 has a center of cut 56 which extends from first side 52 to second side 54 and is of a relatively even depth measured from the plane formed by the surrounding material 32. The shading depicted within each depression 34 is for illustrative purposes to depict the curved shape. A separating strip 58 separates each adjacent set of depressions 34. Separating strip 58 is an area of uncut material 32.

The example SNAP depressions 34 have a length, measured from second edge 50 to first edge 48 of approximately seven inches. A width, measured from first side 52 to second side 54 of approximately sixteen inches and a depth of approximately one half inch. Approximately five inches of uncut material 32 separate each adjacent set of depressions, with the exception of a skip pattern 62 shown in FIG. 2. Therefore, approximately twelve inches, measured from center to center, separate each adjacent set of depressions 34 in a continuous series. Continuous series 46 illustrated in FIG. 1 requires approximately fifty-two hundred and eighty cuts per mile of installation.

FIG. 2 depicts an installation of a skip pattern series 60 of depressions 34 having skip pattern 62 incorporated therein along roadway 30. Rather than continuous installation, elimination of a predetermined group of cuts occurs during installation. The example illustrated produces eight installations followed by the elimination of installation of four in a repetitive loop. Skip pattern series 60 illustrated in FIG. 2 requires approximately thirty-five hundred and twenty cuts per mile of installation.

Depression Forming

The most common method of installing SNAP type depressions is to mill them using a rotary type cutting tool having a plurality of cutting teeth or a plurality of cutting blades. There exists two cutting modes to form SNAP type depressions using a rotary cutting tool.

The first cutting mode is to make a plunge cut. With a plunge cut there is little or no horizontal movement of the cutting tool while in contact with the surface. Therefore, it is a requirement that the cutting tool having a diametric measurement matching, or nearly matching, the resulting cut. Performance of a cutting operation making plunge cuts have two advancement modes. The first advancement mode pauses forward advance of the cutting tool when the cutting tool is brought into and out of contact with the surface to form the depression. With this advancement mode the transport vehicle may pause or the cutting tool may be displaced relative to the moving transport vehicle. The second advancement mode provides for the cutting tool to be advancing slightly when the cutting tool is in contact with the surface during formation of the depression. With this advancement mode the transport vehicle is advancing during the actual cutting procedure.

The second cutting mode is to make a mill through cut. With a mill through cut there is significant horizontal movement of the cutting tool while in contact with the surface. It is also necessary to regulate the horizontal advance of the cutting tool relative to the elevational movement of the cutting tool while in contact with the surface. With a mill through cut the cutting tool will have a diametric measurement significantly smaller than the profile of the resulting depression. It is a requirement that the cutting tool be advancing along the series during formation of a mill through cut.

A cutting cycle is the entirety of steps between a given point during formation of a first depression and the identical point during formation of a second depression by a select cutting tool. These steps include the movement along the series between the actual cutting action when the respective cutting tool is in contact with the surface under treatment. As explained below, blocking of select cutting cycles may prevent installation of a depression during those select cutting cycles.

The series of views of FIG. 3*a* through FIG. 3*g* depict formation of depression 34 using a plunge cutting operation from a paused position. A cutting cycle would include the horizontal movement of a cutting tool 64 to the next position of installation while cutting tool 64 is out of contact with surface 70. The series of views show one, (1), previously installed depression 34. Installation of a second depression 34 results from the motions depicted within the series of views. Cutting tool 64 moves vertically from a maximum elevational position 66, shown in FIG. 3*a*, to a minimum elevational position 68, shown in FIG. 3*d*. This movement is relatively perpendicular to the horizontal and brings cutting tool 64 into contact with surface 70. Following formation of depression 34, cutting tool 64 moves vertically from minimum elevational position 68, shown in FIG. 3*d*, to maximum elevational position 66, shown in FIG. 3*g*. This upward elevational movement brings cutting tool 64 out of contact with surface 70 along the same movement path formed during the decent depicted in FIG. 3*a* through FIG. 3*d*. Therefore, the position of cutting tool 64 is relatively identical before and after formation of each depression 34. Due to the cutting action occurring without any horizontal motion of cutting tool 64, cutting tool 64 has a diametric measurement equal to the diametric profile of the resultant depression 34. Following each installation, horizontal advancement of cutting tool 64 occurs to a position corresponding to the next position of installation by that specific cutting tool.

The series of views of FIG. 4*a* through FIG. 4*g* depict formation of depression 34 using a plunge cutting operation while forward motion exist. The series of views show one, (1), previously installed depression 34 Installation of a second depression 34 results from the motions depicted within the series of views. Cutting tool 64 moves vertically from a maximum elevational position 72, shown in FIG. 4*a*, to a minimum elevational position 74, shown in FIG. 4*d*. This movement occurs during horizontal motion of cutting tool 64 and brings cutting tool 64 into contact with surface 70. Depression 34 is formed while cutting tool 64 is in contact with surface 70. Following reaching minimum elevational position 74, cutting tool 64 moves vertically from minimum elevational position 74, shown in FIG. 4*d*, to maximum elevational position 72, shown in FIG. 4*g*. This upward elevational movement occurs during continued horizontal motion of cutting tool 64. Therefore, horizontal displacement of cutting tool 64 occurs during each cutting cycle which forms each depression 34. Due to the cutting action occurring with only slight horizontal motion of cutting tool 64, cutting tool 64 has a diametric measurement nearly equal to the diametric profile of the resultant depression 34. Cutting tool 64 has an axle 76 which forms an imaginary cutting tool tracking line 78 during the motion of cutting tool 64 through each cutting cycle.

The series of views of FIG. 5*a* through FIG. 5*g* depict formation of depression 34 using a mill through cutting operation. The series of views show one, (1), previously installed depression 34. Installation of a second depression 34 results from the motions depicted within the series of views. A cutting tool 80 descends from a maximum elevation position 82, shown in FIG. 6*a*, to a minimum elevational position 84, shown in FIG. 5*d*. This descending motion occurs during horizontal motion of cutting tool 80. Cutting tool 80 advances a considerable distance horizontally while in contact with surface 70. This contact period further has a descent stage, where lowering of cutting tool 80 occurs, and an accent stage, where raising of cutting tool 80 occurs. Depression 34 is formed while cutting tool 80 is in contact with surface 70. Due to the cutting action occurring during horizontal motion of cutting tool 80, cutting tool 80 has a diametric measurement significantly smaller than the diametric profile of the resultant depression 34. Following reaching minimum elevational position 84, shown in FIG. 5*d*, cutting tool 80 moves to maximum elevational position 82, shown in FIG. 5*g*. Therefore, horizontal displacement of cutting tool 80 occurs during each cutting cycle which forms each depression 34. Cutting tool 80 has an axle 86 which forms an imaginary cutting tool tracking line 88 during the motion of cutting tool 80 through each cutting cycle.

Cutting Action Regulation

There exists many methods of regulating the cutting actions of the cutting tools. When the machine is advancing during formation of the depressions, it is a requirement that the passage of each cutting tool along the surface under treatment regulate the timing of the lowerings and the raisings of that cutting tool. This is required regardless of the methodology of the type of cutting operation being performed, either plunge or mill through.

It is a requirement that the resulting depressions within the series have a proper spacing between each adjacent set of depressions. Therefore, it is a requirement that a measurement taken along the surface under treatment regulate control of the cutting actions of the cutting tools. There exists two measurement methods of providing this measurement along the surface under treatment.

The first measurement method provides for a direct transfer of the cutting action regulation from the measuring device tracking the surface. An example of this is a cam wheel which rolls along the surface. With this method the profile of the wheel and the placement of the axle relative to the profile of the wheel directly controls the cutting action due to the elevational changes to the axle during rotation of the wheel.

The second measurement method provides for an indirect transfer of the cutting action regulation from the measuring device tracking the surface. This involves the use of a conventional wheel with a centered axle where there is a measurement of the roll of the wheel. This surface contract wheel may be a separate component, may be a support component of the cutting tool assembly or may be a support component of a transport vehicle. Several possible transfer modes exist to transfer this measurement to structure which then regulate the cutting action based on the transferred measurement. One transfer mode provides for a direct transfer as exampled by an offset axle which has a portion rotating in a concentric pattern to the prevailing rotation of the axle. Another involves transfer based on a direct transfer via a chain linked to components capable of measuring the passage of the chain and imparting the desired elevational changes to each cutting tool. Yet another is to convert the rotation of the contact wheel to an electronic signal which in turn transfers such signal to components capable of regulating the cutting action dependent upon the received signal.

Figure 6A:
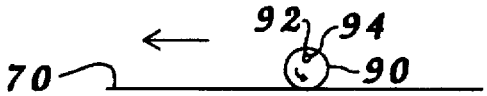
FIG. 6*a* through FIG. 6*c* are side plan views depicting a direct transfer using a cam wheel regulated by travel along the surface under treatment.
Figure 6B:
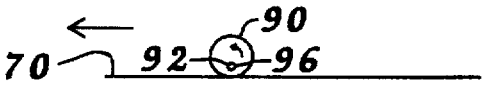
Figure 6C:
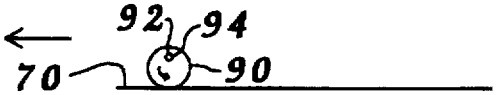

FIG. 6*a* through FIG. 6*c* depict a direct transfer using a cam wheel 90. Cam wheel 90 has an offset axle 92 which supports structure holding a cutting tool, not shown. During rotation of cam wheel 90 along surface 70 offset axle 92 moves through an elevational cycle once for each rotation of cam wheel 90. Each of these elevational cycles move offset axle 92 through a maximum elevational position 94, shown in FIG. 6*a* and FIG. 6*c*, and a minimum elevational position 96, shown in FIG. 6*b*.

One example of use of cam wheel 90 is to deploy multiple cam wheels 90 corresponding to the number of cutting tools. In this deployment linkage components cause all cam wheels 90 to rotate in a synchronized manner. Each cam wheel 90 then regulates a single select cutting tool. The cutting cycle of each cam wheel 90 could be either identical, resulting in a simultaneous cycling, or unique, resulting in an alternating cycling. Another example of use of cam wheel 90 is to deploy a single cam wheel 90 to regulate the simultaneous cycling of all the deployed cutting tools.

Figure 7A:
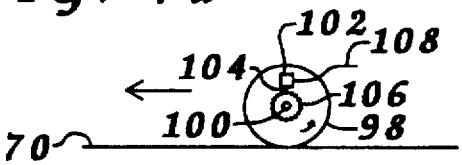
FIG. 7*a* through FIG. 7*c* are side plan views depicting an indirect transfer using an electronic transfer of a series of signals indicative of travel along the surface under treatment.
Figure 7B:
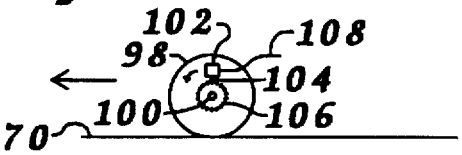
Figure 7C:
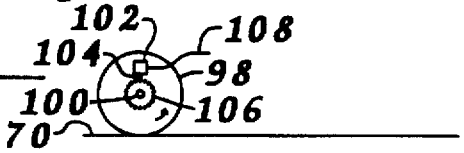
Figures 12A, 12B, 12C, 12D, 12E, 12F, 12G, 12H:
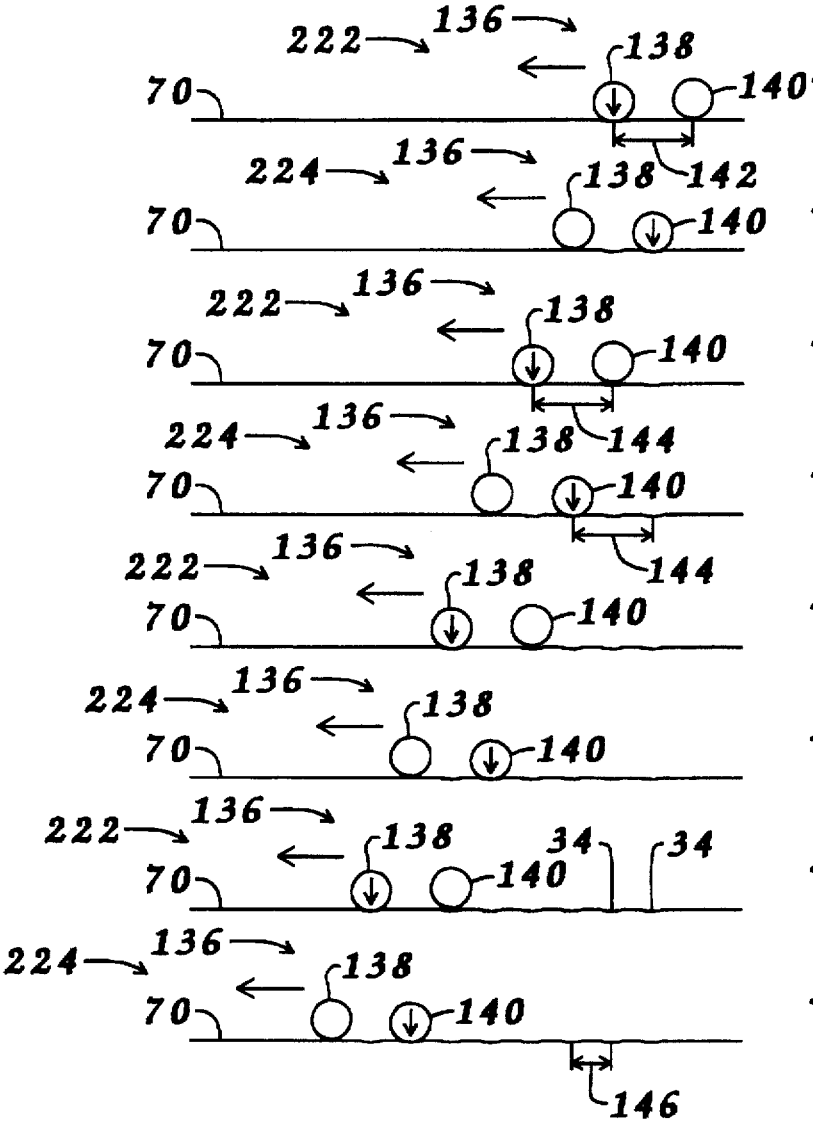
FIG. 12*a* through FIG. 12*h* are side plan views depicting a cutting action of two cutting tools operating in an alternating cycling mode.
Figures 13A, 13B, 13C, 13D, 13E, 13F, 13G, 13H:
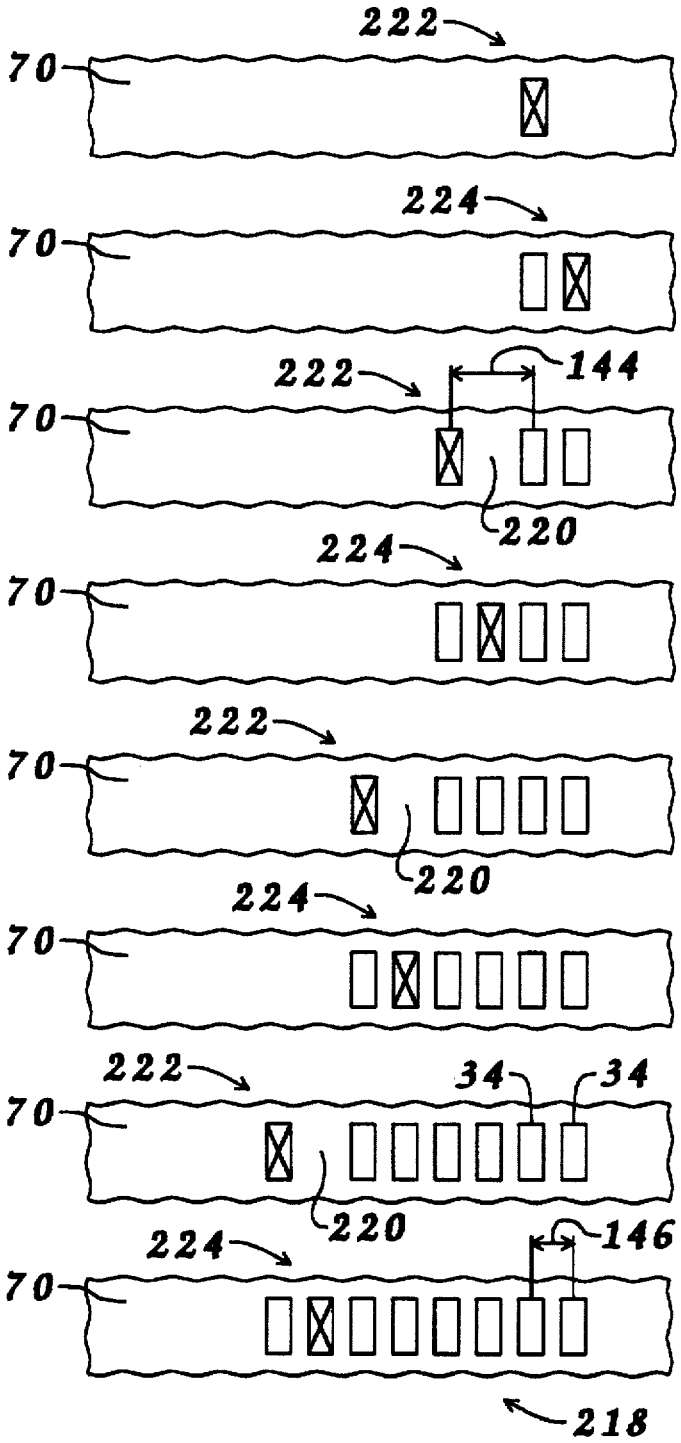
FIG. 13*a* through FIG. 13*h* are overhead plan views of a cutting pattern formed by the cutting actions shown in FIG. 12*a* through FIG. 12*h*.
Figures 14A, 14B, 14C, 14D, 14E, 14F, 14G, 14H, 14I:
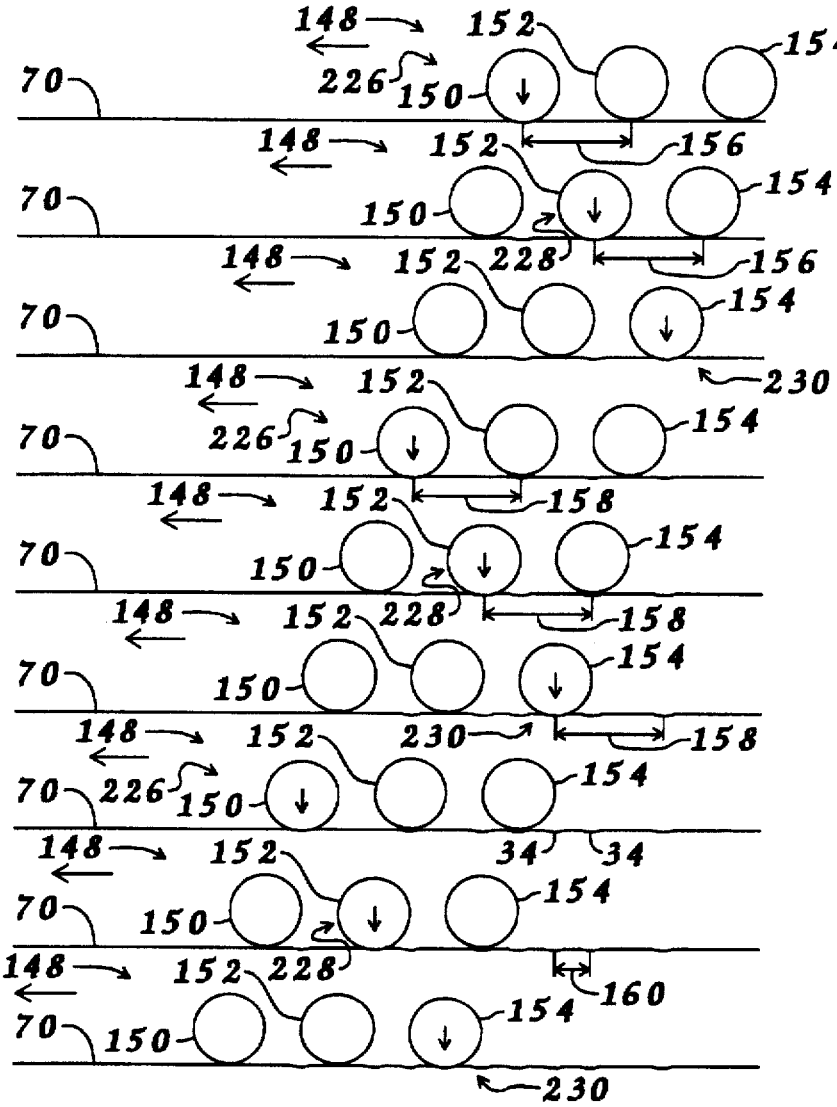
FIG. 14*a* through FIG. 14*i* are side plan views depicting a cutting action of three cutting tools operating in an alternating cycling mode.
Figure 15A:
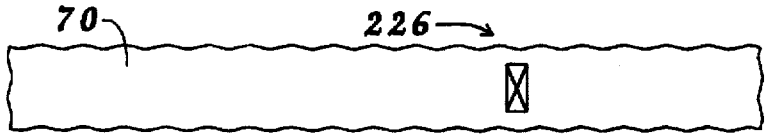
FIG. 15*a* through FIG. 15*i* are overhead plan views of a cutting pattern formed by the cutting actions shown in FIG. 14*a* through FIG. 14*i*.
Figure 15B:
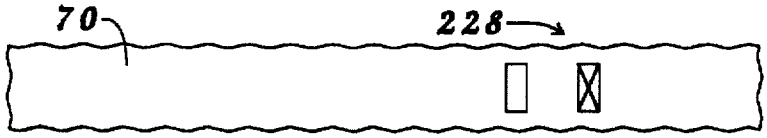
Figure 15C:
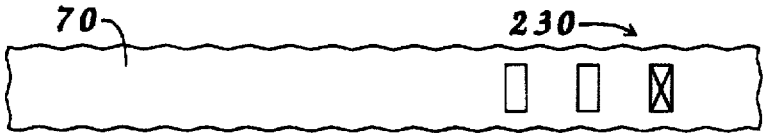
Figure 15D:
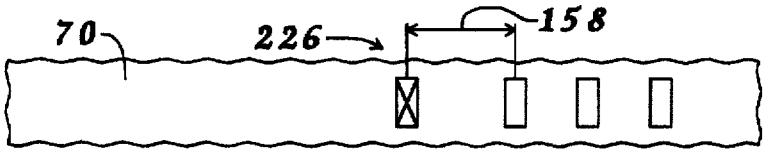
Figure 15E:
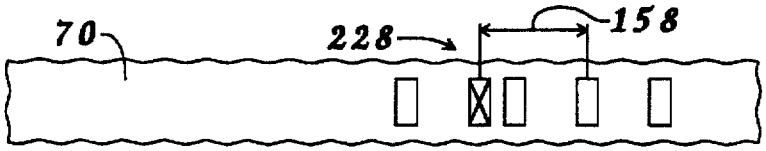
Figure 15F:
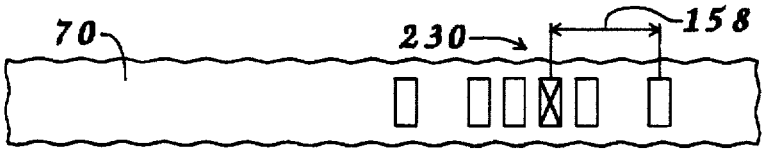
Figure 15G:
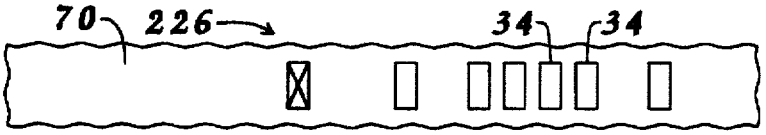
Figure 15H:
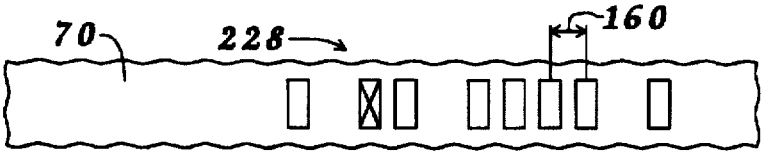
Figure 15I:
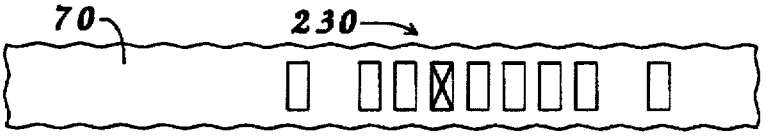

FIG. 7*a* through FIG. 7*c* depict an indirect transfer using a measuring wheel 98 which rolls along surface 70 during usage. Radially distributed uniformly around an axle 100 is a series of pegs 106. Attachment of an electronic counter 102 occurs so as to retain electronic counter 102 stationary relative to axle 100 during rotation of measuring wheel 98. Extending from electronic counter 102 is a toggle 104 which contacts each peg 106 during rotation of measuring wheel 98. Electronic counter 102 is capable of receiving input from toggle 104 during each successive contact with one, (1), peg 106 and transferring an electronic signal along a wire 108 indicative of the travel distance of measuring wheel 98 along surface 70. Other components in turn act upon the received signal along wire 108 and regulate the cutting action of select cutting tools, not shown, to facilitate a cutting action.

Contact Modes

There are two distinct contact modes for the cutting tools. The first contact mode employs the lowering actions together and the raising actions together to move each of the cutting tools in a synchronized manner. The second contact mode employs the lowering actions and the raising actions alternating between the various cutting tools to move each of the cutting tools on different unique cycles. When the machine has three or more cutting tools, the alternating contact mode provides for regulation where each cutting tool is operating on a distinct cycling regiment.

Each cutting tool has a cycle of lowering and raising which corresponds to a travel distance along the surface under treatment. With both simultaneous cycling and alternating cycling a measurement of this cycling distance along the surface under treatment is the cutting tool count multiplied by the measurement of the separation spacing between adjacent depressions.

FIG. 8*a* through FIG. 8*d* and FIG. 10*a* through FIG. 10*e* depict simultaneous cycling using two cutting tools and three cutting tools respectively. FIG. 12*a* through FIG. 12*h* and FIG. 14*a* through FIG. 14*i* depict alternating cycling using two cutting tools and three cutting tools respectively. Additional cutting tools are applicable to both contact modes. Use of any of the cutting modes, mill through, paused plunge cut or advancing plunge cut, may occur with either of the contact modes.

1. Simultaneous Cycling

FIG. 8*a* through FIG. 8*d* depict a synchronized regulation of a cutting assembly 110 comprising a first cutting tool 112 and a second cutting tool 114 during an installation procedure along surface 70. The cutting cycles depicted from FIG. 8*a* to FIG. 8*b*, from FIG. 8*b* to FIG. 8*c* and from FIG. 8*c* to FIG. 8*d* result in the successive installation of eight, (8), depressions 34. The continued repetition of cutting cycles produces a series of depressions having a continuous pattern excepting the second position of placement from the beginning of the series and the second position of placement from the end of the series.

First cutting tool 112 and second cutting tool 114 may move through their respective cutting actions in sync one to the other. First cutting tool 112 and second cutting tool 114 have a cutting tool separation spacing 116 being a measurement from center of first cutting tool 112 to center of second cutting tool 114. Cutting assembly 110 has a cycling distance 118 which is a measurement of travel along surface 70 between successive cutting cycles as previously explained. Installation of a respective depression 34 occurs each time cutting tool 112 or 114 contacts surface 70. Each adjacent set of depressions within the continuous series has a depression separation spacing 120.

FIG. 10*a* through FIG. 10*e* depict a synchronized regulation of a cutting assembly 122 comprising a first cutting tool 124, a second cutting tool 126 and a third cutting tool 128 during an installation procedure along surface 70. The cutting cycles depicted from FIG. 10*a* to FIG. 10*b*, from FIG. 10*b* to FIG. 10*c*, from FIG. 10*c* to FIG. 10*d* and from FIG. 10*d* to FIG. 10*e* result in the successive installation of fifteen, (15), depressions 34. The continued repetition of cutting cycles produces a series of depressions having a continuous pattern excepting the second, third and sixth positions of placement from the beginning of the series and the second, third and sixth position of placement from the end of the series.

First cutting tool 124, second cutting tool 126 and third cutting tool 128 may move through their respective cutting actions in sync one to the others. First cutting tool 124 and second cutting tool 126 have a cutting tool separation spacing 130 being a measurement from center of first cutting tool 124 to center of second cutting tool 126. Second cutting tool 126 and third cutting tool 128 have cutting tool separation spacing 130 being a measurement from center of second cutting tool 126 and center of third cutting tool 128. Cutting assembly 122 has a cycling distance 132 which is a measurement of travel along surface 70 between successive cutting cycles as previously explained. Installation of a respective depression 34 occurs each time cutting tool 124, 126 or 128 contacts surface 70. Each adjacent set of depressions within the continuous series has a depression separation spacing 134.

With simultaneous cycling the specific measurement of the cutting tool separation spacing is arrived at by the following formula. A number representing the cutting tool count has one added to it. Multiplication of this number by any select positive whole number then occurs. Multiplication of this number by the measurement of the respective depression separation spacing then occurs. This number then represents the measurement of the separation spacing between adjacent cutting tools.

2. Alternating Cycling

FIG. 12*a* through FIG. 12*h* depict an alternating regulation of a cutting assembly 136 comprising a first cutting tool 138 and a second cutting tool 140 during an installation procedure along surface 70. Regulation of first cutting tool 138 occurs in a series of cutting cycles depicted from FIG. 12*a* to FIG. 12*c*, from FIG. 12*c* to FIG. 12*e* and from FIG. 12*e* to FIG. 12*g*. Regulation of second cutting tool 140 occurs in a series of cutting cycles depicted from FIG. 12*b* to FIG. 12*d*, from FIG. 12*d* to FIG. 12*f* and from FIG. 12*f* to FIG. 12*h*. The cutting cycle for first cutting tool 138 being regulated opposing the cutting cycle for second cutting tool 140. The cutting cycles of first cutting tool 138 and the cutting cycles of second cutting tool 140 cooperate to successively install the eight, (8), depressions 34 depicted. The continued repetition of the cutting cycles produces a series of depressions having a continuous pattern when performed in even pairs of cutting cycles by first cutting tool 138 and second cutting tool 140.

First cutting tool 138 and second cutting tool 140 may move through their respective cutting actions alternating one to the other. First cutting tool 138 and second cutting tool 140 have a cutting tool separation spacing 142 being a measurement from center of first cutting tool 138 to center of second cutting tool 140. Each cutting tool 138 and 140 has a cycling distance 144 which is a measurement of travel along surface 70 between successive cutting cycles as previously explained. Each time cutting tool 138 or 140 contacts surface 70 a respective depression 34 is installed therein. Each adjacent set of depressions within the continuous series has a depression separation spacing 146.

FIG. 14*a* through FIG. 14*i* depict an alternating regulation of a cutting assembly 148 comprising a first cutting tool 150, a second cutting tool 152 and a third cutting tool 154 during an installation procedure along surface 70. Regulation of first cutting tool 150 occurs in a series of cutting cycles depicted from FIG. 14*a* to FIG. 14*d* and from FIG. 14*d* to FIG. 14*g*. Regulation of second cutting tool 152 occurs in a series of cutting cycles depicted from FIG. 14*b* to FIG. 14*e* and from FIG. 14*e* to FIG. 14*h*. Regulation of third cutting tool 154 occurs in a series of cutting cycles depicted from FIG. 14*c* to FIG. 14*f* and from FIG. 14*f* to FIG. 14*i*. The cutting cycle for first cutting tool 150, the cutting cycle for second cutting tool 152 and the cutting cycle for third cutting tool 154 being each regulated on a unique period from each of the opposing cutting cycles of the other cutting tools. The cutting cycles of first cutting tool 150, the cutting cycles of second cutting tool 152 and the cutting cycles of third cutting tool 154 cooperate to successively install the nine, (9), depressions 34 depicted. The continued repetition of the cutting cycles produces a series of depressions having a continuous pattern excepting the second position of placement from the beginning of the series and various positions of placement from the end of the series depending upon which cutting tool 150, 152 or 154 installed the final depression 34.

First cutting tool 150, second cutting tool 152 and third cutting tool 154 may move through their respective cutting actions alternating one to the others. First cutting tool 150 and second cutting tool 152 have a cutting tool separation spacing 156 being a measurement from center of first cutting tool 150 to center of second cutting tool 152. Second cutting tool 152 and third cutting tool 154 have cutting tool separation spacing 156 being a measurement from center of second cutting tool 152 to center of third cutting tool 154. Each cutting tool 150, 152 and 154 has a cycling distance 158 which is a measurement of travel along surface 70 between successive cutting cycles as previously explained. Installation of a respective depression 34 occurs each time cutting tool 150, 152 or 154 contacts surface 70. Each adjacent set of depressions within the continuous series has a depression separation spacing 160.

With both the simultaneous cycling and the alternating cycling there are two tool placement modes.

The first tool placement mode is fixed, as depicted within the examples depicted herein. With fixed tool placement the separation spacing between adjacent cutting tools remains uniform throughout each cutting cycle for each cutting tool with incidental variation only as results from the lowering and raising of each cutting tool.

The second tool placement mode is variable where displaceable mounting occurs so that each cutting tool may move relative to the cutting assembly. Structural components then repetitively move each cutting tool rearward and forward relative to the cutting assembly during each cutting cycle of that specific cutting tool. Typically, the cutting tool is moved rearward along the cutting assembly during the period of time that the cutting tool is in contact with the surface under treatment. Then the cutting tool is moved forward along the cutting assembly during at least a portion of the period of time that the cutting tool is out of contact with the surface under treatment. This allows for each cutting tool to remain in contact with the surface under treatment during a longer duration of time.

Blocking

With installation using multi-tooled machines it is desirable to provide for complete installation of a series from the first position of placement to the final position of placement without any depressions missing within the series. Multi-tooled machines of the instant invention may operate continually with each cutting tool forming the respective depression during each allotted cycle. This usage may produce resultant series having spacing of untreated surface adjacent the beginning of the series or adjacent the end of the series where installation of depressions should occur within the series. There exists two completion modes to remedy this situation. The first, and the preferred completion mode, is to provide for a controlled blocking of select cutting cycles of select cutting tools at the beginning and end of the series. The second is to simply mill in the missing depressions at the beginning and end of the series following completion of the series.

There are two blocking modes. The first blocking mode is to prevent transfer of the cutting cycle to the selected cutting tool. The second blocking mode is to selectively structurally prevent implementation of the cutting cycle during transfer of the cycle to the selected cutting tool. There are two ways to accomplish this, either by providing for the selected cutting tool to remain at a stationary elevation or by moving the selected cutting tool to a higher elevation to prevent contact during the cycling. Each of these modes results in the selective elimination of performance of a cutting cycle of a lowering and a raising by the selected cutting tool.

Figures 16A, 16B, 16C, 16D, 16E, 17A, 17B, 17C, 17D, 17E:
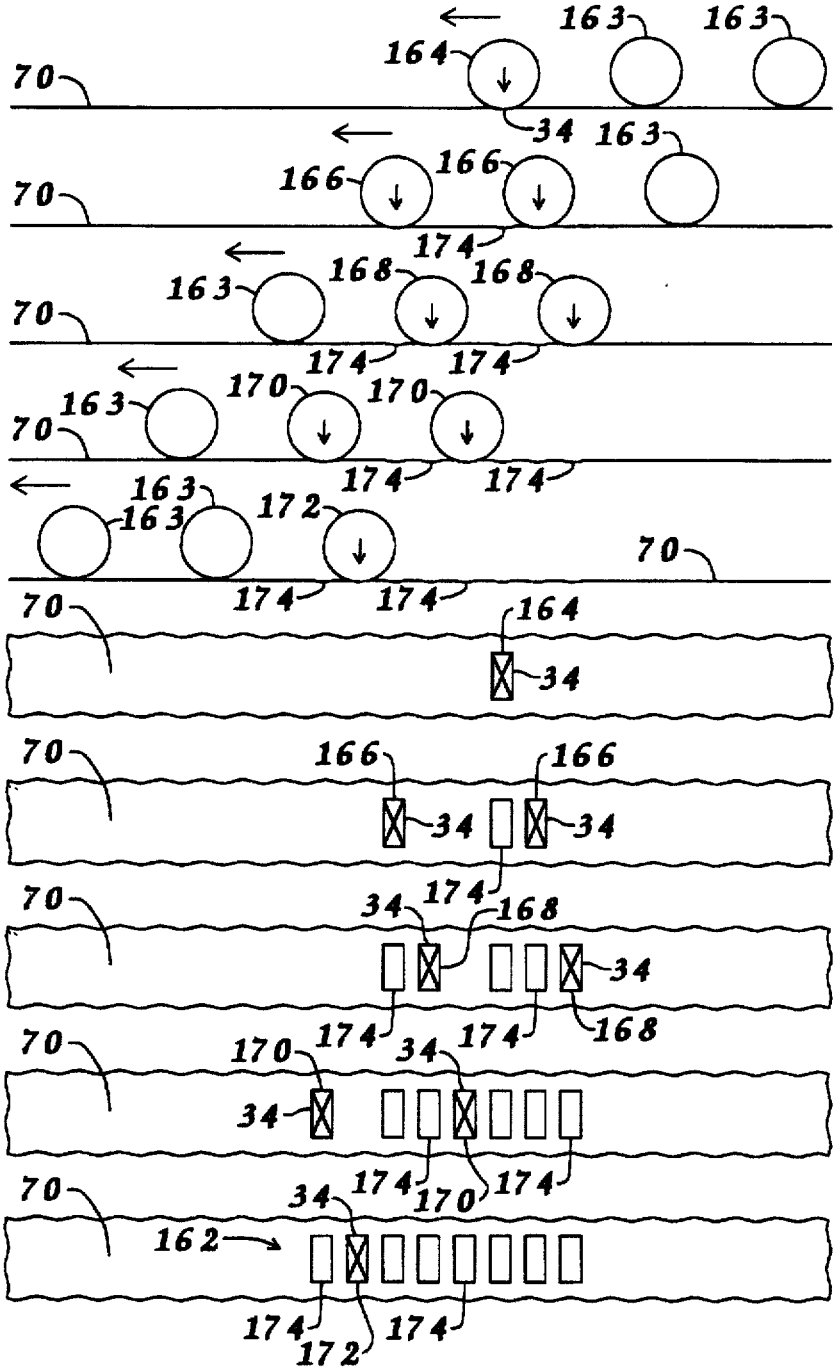
FIG. 16*a* through FIG. 16*e* are side plan views depicting blocking of selective cutting cycles of select cutting tools of the assembly depicted in FIG. 10*a* through FIG. 10*e*.
FIG. 17*a* through FIG. 17*e* are overhead plan views of a cutting pattern formed by the cutting actions shown in FIG. 16*a* through FIG. 16*e*.
Figure 18A:
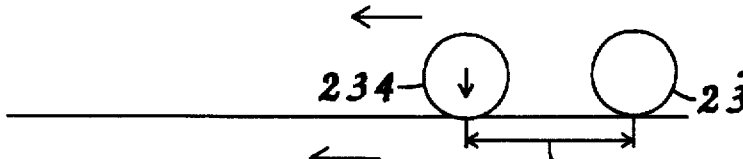
FIG. 18*a* through FIG. 18*h* are side plan views depicting a cutting action of two cutting tools operating in a synchronized cycling mode.
Figure 18B:
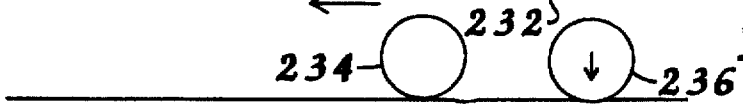
Figure 18C:
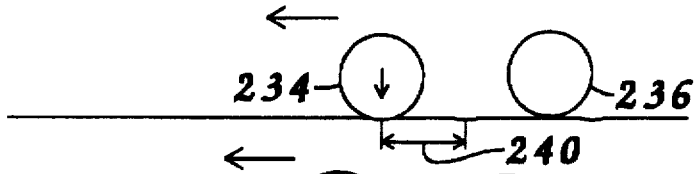
Figure 18D:
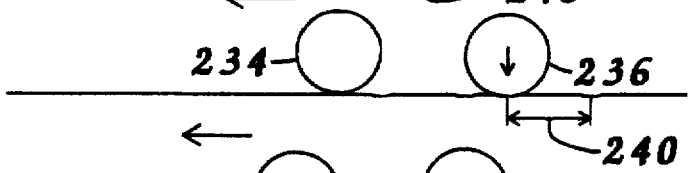
Figure 18E:
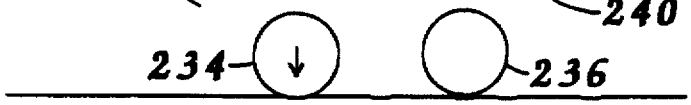
Figure 18F:
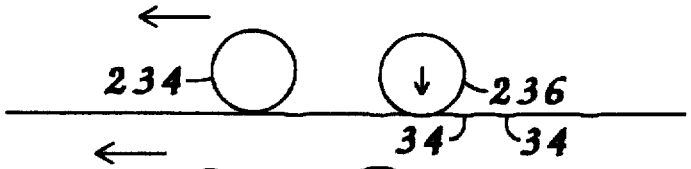
Figure 18G:
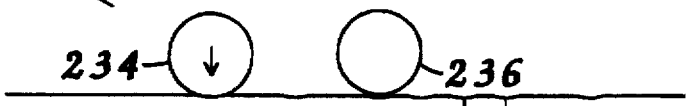
Figure 18H:
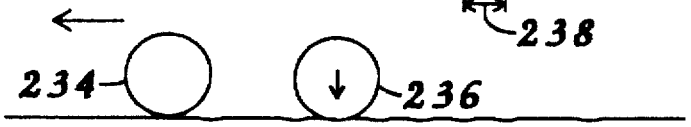
Figure 19A:
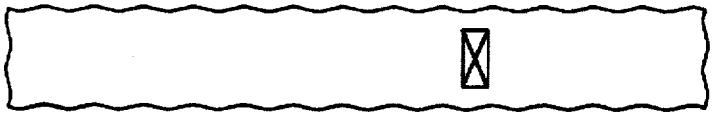
FIG. 19*a* through FIG. 19*h* are overhead plan views of a cutting pattern formed by the cutting actions shown in FIG. 18*a* through FIG. 18*h*.
Figure 19B:
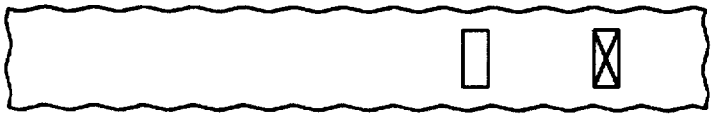
Figure 19C:
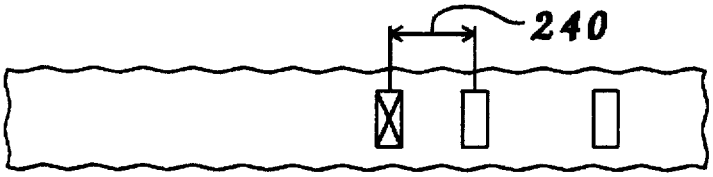
Figure 19D:
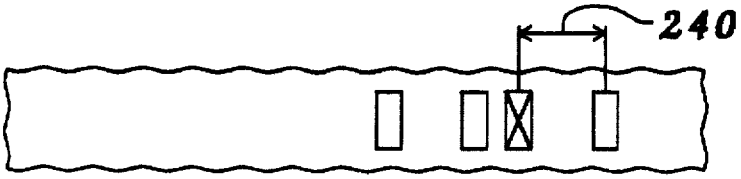
Figure 19E:
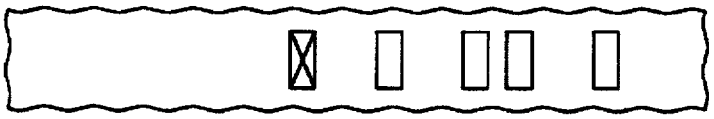
Figure 19F:
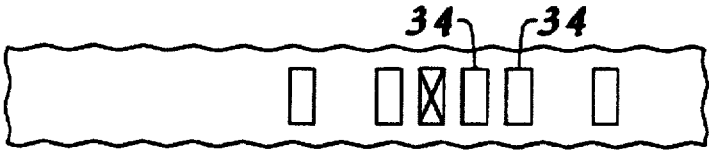
Figure 19G:
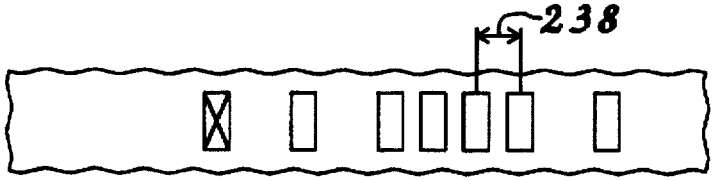
Figure 19H:
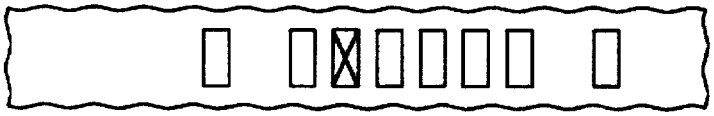

FIG. 16*a* through FIG. 16*e* depict blocking of select cutting cycles for cutting assembly 122 depicted in FIG. 10*a* through FIG. 10*e*. In FIG. 16*a* activation of a cutting cycle blocking 163 eliminates the cutting cycle of second cutting tool 126 and third cutting tool 128 and therefore these cutting cycles do not result in the installation of depressions 34. In FIG. 16*b* activation of cutting cycle blocking 163 eliminates the cutting cycle of third cutting tool 128 and therefore this cutting cycle does not result in the installation of a depression 34.

To provide an extended continuous series using cutting assembly 122 installation of a desired number of cutting cycles wherein all cutting tools 124, 126 and 128 contact surface 70 occurs between FIG. 16*b* and FIG. 16*c*. Implementation of these cutting cycles occur without utilizing any blocking action.

In FIG. 16*c* activation of cutting cycle blocking 163 eliminates the cutting cycle of first cutting tool 124 and therefore this cutting cycle does not result in the installation of a depression 34. In FIG. 16*d* activation of cutting cycle blocking 163 eliminates the cutting cycle of first cutting tool 124 and therefore this cutting cycle does not result in the installation of a depression 34. In FIG. 16*e* activation of cutting cycle blocking 163 eliminates the cutting cycles of first cutting tool 124 and second cutting tool 126 and therefore these cutting cycles do not result in the installation of depressions 34. These actions produces an extended continuous series having complete coverage from beginning to end.

Selective blocking permits installation of series having any desired number of depressions and complete coverage without spacing of unintended untreated surface. FIG. 17*a* through FIG. 17*e* depict a cutting pattern 162 resulting from the cutting cycles depicted in FIG. 16*a* through FIG. 16*e*. FIG. 16*a* and FIG. 17*a* show a first cutting cycle contact 164 which results in the installation of one, (1), depression 34. FIG. 16*b* and FIG. 17*b* show a second cutting cycle contact 166 which results in the installation of two, (2), depressions 34. One, (1), previously installed depression 174 is shown as result from previously performed first cutting cycle contact 164. FIG. 16*c* and FIG. 17*c* show a third cutting cycle contact 168 which results in the installation of two, (2), depressions 34. Three, (3), previously installed depressions 174 are shown as result from previously performed first cutting cycle contact 164 and second cutting cycle contact 166. FIG. 16*d* and FIG. 17*d* show a fourth cutting cycle contact 170 which results in the installation of two, (2), depressions 34. Five, (5), previously installed depressions 174 are shown as result from previously performed first cutting cycle contact 164, second cutting cycle contact 166 and third cutting cycle contact 168. FIG. 16*e* and FIG. 17*e* show a fifth cutting cycle contact 172 which results in the installation of one, (1), depression 34. Seven, (7), previously installed depressions 174 are shown as result from previously performed first cutting cycle contact 164, second cutting cycle contact 166, third cutting cycle contact 168 and fourth cutting cycle contact 170.

Incorporation of a skip pattern within the series is possible using a regulation of the blocking means described above performed in a regulated manner repetitively throughout installation of the series. This is true regardless of the number of cutting tools, the cutting tool separation spacing or the contact mode selected.

Multi-tooled Cutting Patterns

Machines having multiple cutting tools produce definable patterns of placement for each depression formed by each cutting tool. A repetition of identical cycles for each of the cutting tools cooperate to form the continuous pattern. Differing installation sequence patterns exist depending upon the number of cutting tools, the separation spacing between adjacent cutting tools and the contact mode being utilized. Selective blocking of the cutting cycle of select cutting tools, explained above, alter the resultant cutting patterns, and permit true continuous series or series having a skip pattern incorporated therein. The examples which follow explain the placement sequence during installation procedures for several of the many patterns possible.

1. Simultaneous Cycling

FIG. 9*a* through FIG. 9*d* depict formation of a cutting pattern 176, shown in FIG. 9*d*, resulting from the cutting cycles depicted in FIG. 8*a* through FIG. 8*d*. Cutting pattern 176 has an untreated second position of placement from beginning 178 and an untreated second position of placement from end 180. As detailed above, implementation of selective blocking can eliminate such untreated areas within the series of depressions. FIG. 8*a* and FIG. 9*a* show a first cutting cycle contact 182 which results in the installation of two, (2), depressions 34. FIG. 8*b* and FIG. 9*b* show a second cutting cycle contact 184 which results in the installation of two, (2), depressions 34. Two, (2), previously installed depressions 190 are shown as result from previously performed first cutting cycle contact 182. FIG. 8*c* and FIG. 9*c* show a third cutting cycle contact 186 which results in the installation of two, (2), depressions 34. Four, (4), previously installed depressions 190 are shown as result from previously performed first cutting cycle contact 182 and second cutting cycle contact 184. FIG. 8*d* and FIG. 9*d* show a fourth cutting cycle contact 188 which results in the installation of two, (2), depressions 34. Six, (6), previously installed depressions 190 are shown as result from previously performed first cutting cycle contact 182, second cutting cycle contact 184 and third cutting cycle contact 186.

FIG. 11*a* through FIG. 11*e* depict formation of a cutting pattern 192, shown in FIG. 11*e*, resulting from the cutting cycles depicted in FIG. 10*a* through FIG. 10*e*. Cutting pattern 192 has an untreated second position of placement from beginning 194, an untreated third position of placement from beginning 196 and an untreated sixth position of placement from beginning 198. Cutting pattern 192 also has an untreated second position of placement from end 200, an untreated third position of placement from end 20288 and an untreated sixth position of placement from end 204. As detailed above, implementation of selective blocking can eliminate such untreated areas within the series of depressions. FIG. 10*a* and FIG. 11*a* show a first cutting cycle contact 206 which results in the installation of three, (3), depressions 34. FIG. 10*b* and FIG. 11*b* show a second cutting cycle contact 208 which results in the installation of three, (3), depressions 34. Three, (3), previously installed depressions 216 are shown as result from previously performed first cutting cycle contact 206. FIG. 10*b* and FIG. 11*c* show a third cutting cycle contact 210 which results in the installation of three, (3), depressions 34. Six, (6), previously installed depressions 216 are shown as result from previously performed first cutting cycle contact 206 and second cutting cycle contact 208. FIG. 10*d* and FIG. 11*d* show a fourth cutting cycle contact 212 which results in the installation of three, (3), depressions 34. Nine, (9), previously installed depressions 216 are shown as result from previously performed first cutting cycle contact 206, second cutting cycle contact 208 and third cutting cycle contact 210. FIG. 10*e* and FIG. 11*e* show a fifth cutting cycle contact 214 which results in the installation of three, (3), depressions 34. Twelve, (12), previously installed depressions 216 are shown as result from previously performed first cutting cycle contact 206, second cutting cycle contact 208, third cutting cycle contact 210 and fourth cutting cycle contact 212.

2. Alternating Cycling

When utilizing an alternating cycling contact mode each separate cutting tool has a unique cutting cycle contact period. While each cutting tool has a unique timing of the cutting cycle, each of the cutting cycles will be identical in their measurement along the surface under treatment.

FIG. 12*a* through FIG. 12*h* and FIG. 13*a* through FIG. 13*h* depict use of two, (2), cutting tools operating in an alternating cycling mode. First cutting tool 138 has a first cutting tool cutting cycle contact 222 and second cutting tool 140 has a second cutting tool cutting cycle contact 224. For every travel of distance along surface 70 equal to the measurement of depression separation spacing 146 one of the two, (2), cutting tools 138 or 140 comes into contact with surface 70 and forms one, (1), depression 34. Cycling distance 144, applicable to both first cutting tool 138 and second cutting tool 140, will be the cutting tool count, being two, (2), multiplied by depression separation spacing 146. A cutting pattern 218 has an untreated second position of placement from end 220 following each first cutting tool cutting cycle contact 222 following the first occurrence of second cutting tool cutting cycle contact 224. As detailed above, implementation of selective blocking can eliminate such untreated areas within the series of depressions.

FIG. 14*a* through FIG. 14*i* and FIG. 15*a* through FIG. 15*i* depict use of three, (3), cutting tools operating in an alternating cycling mode. First cutting tool 150 has a first cutting tool cutting cycle contact 226, second cutting tool 152 has a second cutting tool cutting cycle contact 228 and third cutting tool 154 has a third cutting tool cutting cycle contact 230. For every travel of distance along surface 70 equal to the measurement of depression separation spacing 160 one of the three, (3), cutting tools 150, 152 or 154 comes into contact with surface 70 and forms one, (1), depression 34. Cycling distance 158, applicable to first cutting tool 150, second cutting tool 152 and third cutting tool 154, will be the cutting tool count, being three, (3), multiplied by depression separation spacing 160. Various cutting patterns, having various untreated areas, exist at various periods of installation depending upon the last cutting tool 150, 152 or 154 to have formed a depression 34. As detailed above, implementation of selective blocking can eliminate such untreated areas within the series of depressions.

Separation Spacing of Cutting Tools

Each adjacent set of cutting tools will have a separation spacing measured from the center of one cutting tool to the center of the adjacent cutting tool. This spacing will be dependent upon the contact mode being utilized and the count of the cutting tools deployed. For simultaneous cycling contact modes the cutting tool separation spacing will be a multiple of the cutting tool count then the addition of one then multiplied by the measurement of the spacing between adjacent depressions within the series. For alternating cycling contact modes the cutting tool separation spacing will be a multiple of the cutting tool count then multiplied by the measurement of the spacing between adjacent depressions within the series.

Each machine of the instant invention will have an installation sequence of depressions relative to previously installed depressions. For simultaneous cycling this will be the relative simultaneous placement of depressions by the cutting tools. For alternating cycling this will be the relative individual placement of depressions by each separate cutting tool.

Referring now to FIG. 12*a* through FIG. 13*h* and FIG. 18*a* through FIG. 19*h*, the contact mode for each set of views is an alternating cycling. The cutting tool separation spacing 142 between first cutting tool 138 and second cutting tool 140 in FIG. 12*a* through FIG. 12*h* is a multiple, being one, (1), of the cutting tool count, being two, (2), multiplied by the depression separation spacing 146 between adjacent depressions 34. A cutting tool separation spacing 232 between a first cutting tool 234 and a second cutting tool 236, shown in FIG. 18*a* through FIG. 18*h*, is a multiple, being two, (2), of the cutting tool count, being two, (2), multiplied by a depression separation spacing 238 between adjacent depressions 34.

Use of similar calculation allow determination of the separation spacing between adjacent cutting tools depending upon the cutting tool count utilized, the contact mode utilized and the separation spacing between adjacent depressions within the intended series.

A measurement of cycling distance 144 and a cycling distance 240 remains the same without regard for the measurement of cutting tool separation spacing 142 and cutting tool separation spacing 232. FIG. 18*a* through FIG. 19*h* depict the change in relative placement of depressions 34 during an installation sequence when compared to the installation sequence depicted in FIG. 12*a* through FIG. 12*h*.

Example Milling Machine

Figure 20:
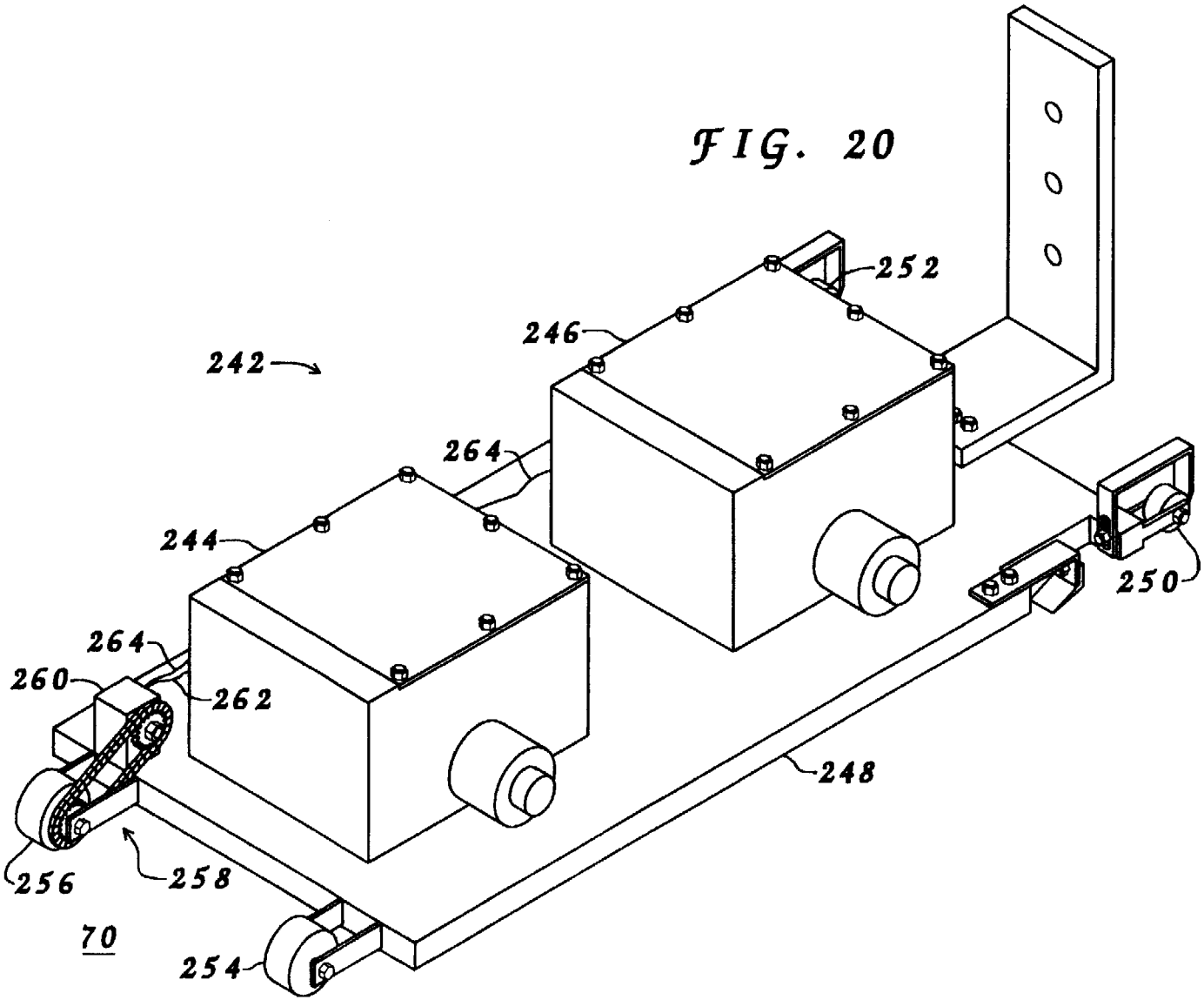
FIG. 20 is a perspective view of one embodiment of a milling machine having features of the instant invention.

FIG. 20 depicts one example milling machine 242 having a first cutting tool housing 244 and a second cutting tool housing 246 each secured to a support chassis 248. First cutting tool housing 244 contains a cutting tool, not shown, capable of milling a depression into the surface of a road and adaptable for selective elevational positioning by displacement components, not shown, such as hydraulic drives. Second cutting tool housing 246 contains a cutting tool, not shown, capable of milling a depression into the surface of a road and adaptable for selective elevational positioning by displacement components, not shown, such as hydraulic drives.

Milling machine 242 has a first rear support wheel 250 and a second rear support wheel 252 each to provide for support and transport of milling machine 242 along surface 70. Milling machine 242 has a first front support wheel 254 and a second front support wheel 256 each to provide for support and transport of milling machine 242 along surface 70.

A transfer assembly 258 transfers rotation of second front support wheel 256 to an electronic measurement counter 260. Electronic measurement counter 260 contains components conventionally known in the art capable of generating controlled electronic transmissions indicative of rotation of second front support wheel 256. Rotation of second front support wheel 256 is indicative of a measurement of travel of milling machine 242 along surface 70. A first wire 262 sends electronic transmissions to the displacement components contained in first cutting tool housing 244. A second wire 264 similarly sends electronic transmissions to the displacement components contained in second cutting tool housing 246.

These electronic transmissions then cause the displacement components to move the respective cutting tools upward and downward into and out of contact with surface 70 to form depressions, not shown. Electronic measurement counter 260 may similarly have the ability to regulate activation of select cutting cycles to regulate installation of the series to provide for series having a continuous pattern or a skip pattern incorporated therein.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

We claim:

1. A multi-tooled milling machine for milling a series of depressions in a surface of a road, adjacent depressions within the series of depressions having a depression separation spacing, the depression separation spacing having a measured distance along the surface of the road measured from center of one depression to center of an adjacent depression, the multi-tooled milling machine comprising:

a) transport means to provide for advance of the multi-tooled milling machine along the surface during milling of the series of depressions;

b) a plurality of cutting tools have a cutting tool count equal to the number of cutting tools and each adjacent pair of cutting tools having a fixed cutting tool separation spacing measured from center of one cutting tool to center of other adjacent cutting tools, the fixed cutting tool separation spacing of each adjacent pair of cutting tools equal to the cutting tool count multiplied by any select positive whole number then an addition of one then a multiplication by the depression separation spacing of the depressions;

c) regulation means governed by movement of the multi-tooled milling machine along the surface, the regulation means to provide for a series of cycles, each cycle comprising;

1) a simultaneous lowering of select cutting tools, each of the select cutting tools contacting the surface during the lowering to begin a cutting action to form one depression;

2) a simultaneous raising of the select cutting tools to terminate the cutting action;

whereby the multi-tooled milling machine advances along the surface and using the series of cycles simultaneous lowerings and simultaneous raisings governed by the advance of the multi-tooled milling machine cause milling of depressions within the series.

2. The multi-tooled milling machine defined in claim 1 wherein; each of the cutting tools has a cutting diametric measurement smaller than a diametric extended measurement of a formed depression milled by each of the cutting tools and each of the cutting tools advance along the surface while in contact with the surface a greater measured distance than a measured distance of a penetration of the road by each of the cutting tools;

whereby each of the cutting tools form depressions by making a milled through cut.

3. The multi-tooled milling machine defined in claim 1 wherein; each of the cutting tools has a cutting diametric measurement relatively equal to a diametric extended measurement of a formed depression milled by one of the cutting tools;

whereby each of the cutting tools form depressions by making plunge cuts.

4. A multi-tooled machine for milling a series of depressions in a surface of a road, adjacent depressions within the series of depressions having a depression separation spacing, the depression separation spacing having a measured distance along the surface of the road measured from center of one depression to center of an adjacent depression, the multi-tooled machine comprising:

a) transport means to provide for advance of the multi-tooled milling machine along the surface during milling of the series of depressions;

b) a plurality of cutting tools have a cutting tool count equal to the number of cutting tools and each adjacent pair of cutting tools having a fixed cutting tool separation spacing measured from center of one cutting tool to center of other adjacent cutting tools, the fixed cutting tool separation spacing of each adjacent pair of cutting tools equal to the cutting tool count multiplied by any select positive whole number then a multiplication by the depression separation spacing of the depressions;

c) regulation means governed by the advance of the multi-tooled milling machine along the surface, the regulation means to provide for;

1) a unique lowering cycle for each cutting tool;

2) a unique raising cycle for each cutting tool;

3) select means to provide for selection of which cutting tools of the plurality of cutting tools are lowered and raised to form depressions during respective lowering cycle and raising cycle of each cutting tool;

whereby the multi-tooled machine advances along the surface and the select means cause the respective lowering cycle and raising cycle of each cutting tool to cause milling of depressions within the series.

5. The multi-tooled machine defined in claim 4 wherein; each of the cutting tools has a cutting diametric measurement smaller than a diametric extended measurement of a formed depression milled by each of the cutting tools and each of the cutting tools advance along the surface while in contact with the surface a greater measured distance than a measured distance of a penetration of the road by each of the cutting tools;

whereby each of the cutting tools form depressions by making a milled through cut.

6. The multi-tooled machine defined in claim 4 wherein; each of the cutting tools has a cutting diametric measurement relatively equal to a diametric extended measurement of a formed depression milled by one of the cutting tools;

whereby each of the cutting tools form depressions by making plunge cuts.

7. A machine for forming a series of depressions in a surface of a road, the machine comprising:

a) transport means to provide for a controlled advance of the machine along a path of the series of depressions;

b) a first cutting tool capable of milling the surface of the road;

c) a second cutting tool capable of milling the surface of the road;

d) a cycle comprising;

1) a first cutting tool lowering period;

2) a second cutting tool lowering period, the first cutting tool lowering period and the second cutting tool lowering period occurring at the same time;

3) a first cutting tool raising period;

4) a second cutting tool raising period, the first cutting tool raising period and the second cutting tool raising period occurring at the same time;

the cycle regulated by a passage of the machine along the surface of the road and repetitively performed during the passage of the machine along the surface of the road, each cycle having a distance measurement, the distance measurement a travel distance of the machine along the road and equal to two multiplied by the spacing of adjacent depressions within the series of depressions;

e) first cutting tool elevation regulation means to provide for a decrease in an elevational height and an increase in the elevational height, the decrease in the elevational height bringing the first cutting tool into contact with the surface of the road and consuming the first cutting tool lowering period, the increase in the elevational height taking the first cutting tool out of contact with the surface of the road and consuming the first cutting tool raising period;

f) second cutting tool elevation regulation means to provide for a decrease in an elevational height and an increase in the elevational height, the decrease in the elevational height bringing the second cutting tool into contact with the surface of the road and consuming the second cutting tool lowering period, the increase in the elevational height taking the second cutting tool out of contact with the surface of the road and consuming the second cutting tool raising period;

whereby the machine advances along the path of the series of depressions while the first cutting tool elevation regulation means cause the first cutting tool to form even numbered depressions within the series of depressions and the second cutting tool elevation regulation means cause the second cutting tool to form odd numbered depressions with the series of depressions.

8. The machine defined in claim 7 wherein; the first cutting tool and the second cutting tool having a fixed spacing, the fixed spacing measured from a center of the first cutting tool to a center of the second cutting tool, the fixed spacing equal to two multiplied by any select positive whole number then an addition of one then a multiplication by a spacing of adjacent depressions of the series of depressions, the spacing of adjacent depressions measured from a center of one depression to a center of an adjacent depression.

9. The machine defined in claim 7 wherein:

a) the first cutting tool has a cutting diametric measurement smaller than a diametric extended measurement of a formed depression milled by the first cutting tool and the first cutting tool advances along the desired path of the series of depressions while in contact with the surface of the road a greater measured distance than a measured distance of a penetration of the road by the first cutting tool;

b) the second cutting tool has a cutting diametric measurement smaller than a diametric extended measurement of a formed depression milled by the second cutting tool and the second cutting tool advances along the desired path of the series of depressions while in contact with the surface of the road a greater measured distance than a measured distance of a penetration of the road by the second cutting tool;

whereby the first cutting tool and the second cutting tool form depressions by making milled through cuts.

10. The machine defined in claim 7 wherein; the first cutting tool has a cutting diametric measurement relatively equal to a diametric extended measurement of a formed depression milled by the first cutting tool and the second cutting tool has a cutting diametric measurement relatively equal to a diametric extended measurement of a formed depression milled by the second cutting tool;

whereby the first cutting tool and the second cutting tool form depressions by making plunge cuts.

11. A machine to provide for cutting of a continuous series of depressions in a surface of a road, the continuous series having odd numbered depressions and even numbered depressions, the odd numbered depressions beginning with the first depression within the continuous series and then including every other depression within the continuous series, the even numbered depressions beginning with the second depression within the continuous series and then including every other depression within the continuous series, the machine comprising:

a) a cutting assembly having a first cutting tool and a second cutting tool, each of the cutting tools capable of milling the surface of the road;

b) advance means to propel the machine along a desired path during cutting of the series of depressions;

c) regulation means governed by a passage of the machine along the surface of the road, the regulation means to provide for a repetitive performance of a cycle, each cycle comprising:

1) a first cutting tool lowering period capable of providing for the first cutting tool to be brought into contact with the surface to begin a cutting action to form a single odd numbered depression;

2) a first cutting tool raising period capable of providing for the first cutting tool to be taken out of contact with the surface to terminate the cutting action of the single odd numbered depression;

3) a second cutting tool lowering period capable of providing for the second cutting tool to be brought into contact with the surface to begin a cutting action to form a single even numbered depression;

4) a second cutting tool raising period capable of providing for the second cutting tool to be taken out of contact with the surface to terminate the cutting action of the single even numbered depression;

the first cutting tool lowering period occurring at a different time than the second cutting tool lowering period, the first cutting tool raising period occurring a different time than the second cutting tool raising period, the regulation means to provide for placement of the odd numbered depressions and the even numbered depressions such that the odd numbered depressions and the even numbered depressions are placed with a uniform spacing between adjacent depressions within the continuous series;

whereby the machine advances along a desired path while the regulation means causes the first cutting tool and the second cutting tool to alternate lowering and raising actions to form depressions within the continuous series of depressions.

12. The machine defined in claim 11 wherein; the first cutting tool and the second cutting tool having a fixed spacing, the fixed spacing measured from a center of the first cutting tool to a center of the second cutting tool, the fixed spacing equal to two multiplied by any select positive whole number then a multiplication by a spacing of adjacent depressions of the series of depressions, the spacing of adjacent depressions measured from a center of one depression to a center of an adjacent depression.

13. The machine defined in claim 11 wherein:

a) the first cutting tool has a cutting diametric measurement smaller than a diametric extended measurement of a formed depression milled by the first cutting tool and the first cutting tool advances along the desired path of the continuous series of depressions while in contact with the surface of the road a greater measured distance than a measured distance of a penetration of the road by the first cutting tool;

b) the second cutting tool has a cutting diametric measurement smaller than a diametric extended measurement of a formed depression milled by the second cutting tool and the second cutting tool advances along the desired path of the continuous series of depressions while in contact with the surface of the road a greater measured distance than a measured distance of a penetration of the road by the second cutting tool;

whereby the first cutting tool and the second cutting tool form depressions by making milled through cuts.

14. The machine defined in claim 11 wherein; the first cutting tool has a cutting diametric measurement relatively equal to a diametric extended measurement of a formed depression milled by the first cutting tool and the second cutting tool has a cutting diametric measurement relatively equal to a diametric extended measurement of a formed depression milled by the second cutting tool;

whereby the first cutting tool and the second cutting tool form depressions by making plunge cuts.

* * * * *